US010920294B2

(12) United States Patent
Kohsaka et al.

(10) Patent No.: US 10,920,294 B2
(45) Date of Patent: Feb. 16, 2021

(54) STEEL SHEET, COATED STEEL SHEET, METHOD FOR PRODUCING HOT-ROLLED STEEL SHEET, METHOD FOR PRODUCING FULL-HARD COLD-ROLLED STEEL SHEET, METHOD FOR PRODUCING HEAT-TREATED SHEET, METHOD FOR PRODUCING STEEL SHEET, AND METHOD FOR PRODUCING COATED STEEL SHEET

(71) Applicant: JFE STEEL CORPORATION, Tokyo (JP)

(72) Inventors: Noriaki Kohsaka, Tokyo (JP); Yoshimasa Funakawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 202 days.

(21) Appl. No.: 16/089,193

(22) PCT Filed: Mar. 17, 2017

(86) PCT No.: PCT/JP2017/010820
§ 371 (c)(1),
(2) Date: Sep. 27, 2018

(87) PCT Pub. No.: WO2017/169870
PCT Pub. Date: Oct. 5, 2017

(65) Prior Publication Data

US 2019/0112682 A1 Apr. 18, 2019

(30) Foreign Application Priority Data

Mar. 31, 2016 (JP) ..... JP2016-070738

(51) Int. Cl.

| | |
|---|---|
| ***C21D 9/46*** | (2006.01) |
| ***C21D 8/02*** | (2006.01) |
| ***C23C 2/06*** | (2006.01) |
| ***C23C 2/40*** | (2006.01) |
| ***C22C 38/14*** | (2006.01) |
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/32*** | (2006.01) |
| ***C22C 38/18*** | (2006.01) |
| *C22C 38/08* | (2006.01) |
| *C22C 38/16* | (2006.01) |
| *C22C 38/22* | (2006.01) |
| *C22C 38/26* | (2006.01) |
| *C22C 38/38* | (2006.01) |

(52) U.S. Cl.
CPC ..... *C21D 8/0226* (2013.01); *C21D 8/0236* (2013.01); *C21D 9/46* (2013.01); *C22C 38/00* (2013.01); *C22C 38/001* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/32* (2013.01); *C22C 38/60* (2013.01); *C23C 2/06* (2013.01); *C23C 2/40* (2013.01); *C21D 2211/005* (2013.01); *C21D 2211/008* (2013.01); *C22C 38/002* (2013.01); *C22C 38/008* (2013.01); *C22C 38/08* (2013.01); *C22C 38/16* (2013.01); *C22C 38/22* (2013.01); *C22C 38/26* (2013.01); *C22C 38/38* (2013.01)

(58) Field of Classification Search
CPC ..... C23C 2/02; C21D 8/0226; C21D 8/0236; C21D 9/46
See application file for complete search history.

(56) References Cited

U.S. PATENT DOCUMENTS

| | | | | |
|---|---|---|---|---|
| 6,743,307 | B1 | 6/2004 | Engl et al. | |
| 2014/0234655 | A1* | 8/2014 | Takashima | C22C 38/06 428/659 |
| 2017/0152580 | A1 | 6/2017 | Kimura et al. | |

FOREIGN PATENT DOCUMENTS

| | | | |
|---|---|---|---|
| CN | 1367846 | A | 9/2002 |
| CN | 1547620 | A | 11/2004 |
| EP | 1143022 | A1 | 10/2001 |
| EP | 1431407 | A1 | 6/2004 |
| EP | 2623629 | A1 | 8/2013 |
| EP | 3054025 | A1 | 8/2016 |
| JP | H04-247829 | A | 9/1992 |
| JP | 2000-109951 | A | 4/2000 |
| JP | 2000-290730 | A | 10/2000 |
| JP | 2004-211140 | A | 7/2004 |
| JP | 2006-63360 | A | 3/2006 |
| JP | 2006-283130 | A | 10/2006 |

(Continued)

OTHER PUBLICATIONS

English Language translation of JP 2000-109951 A (Year: 2000).*

(Continued)

*Primary Examiner* — Scott R Kastler
(74) *Attorney, Agent, or Firm* — Oliff PLC

(57) ABSTRACT

A steel sheet having low yield ratio, tensile strength of 780 MPa or more, and good bending fatigue properties. The steel sheet includes a specific chemical composition and a steel microstructure having an area percentage of a ferrite phase of 20% or more and 80% or less and an area percentage of a martensite phase of 20% or more and 80% or less, the area percentage being determined by microstructure observation, in which a surface layer portion of the steel sheet has an average ferrite grain size of 5.0 μm or less and an inclusion density of 200 particles/mm$^{-2}$ or less, and in which the steel sheet has a surface hardness of 95% or more when the steel sheet has a hardness of 100% at a position ½t, where t represents the thickness of the steel sheet, away from a surface of the steel sheet in the thickness direction.

20 Claims, No Drawings

(56) References Cited

FOREIGN PATENT DOCUMENTS

| | | | |
|---|---|---|---|
| JP | 2007-262553 | A | 10/2007 |
| JP | 2008-156734 | A | 7/2008 |
| JP | 2010-275628 | A | 12/2010 |
| JP | 4772927 | B2 | 9/2011 |
| KR | 10-2013-0094325 | A | 8/2013 |
| WO | 2015/093043 | A1 | 6/2015 |
| WO | 2016/013144 | A1 | 1/2016 |
| WO | 2016/013145 | A1 | 1/2016 |

OTHER PUBLICATIONS

Jun. 20, 2017 International Search Report issued in International Application No. PCT/JP2017/010820.
Apr. 13, 2020 Notice of Allowance issued in Korean Patent Application No. 10-2018-7028113.
Oct. 30, 2019 Office Action issued in Korean Patent Application No. 10-2018-7028113.
Feb. 19, 2019 Extended Search Report issued in European Patent Application No. 17774414.1.
Dec. 2, 2019 Office Action issued in Chinese Patent Application No. 201780021233.1.

* cited by examiner

STEEL SHEET, COATED STEEL SHEET, METHOD FOR PRODUCING HOT-ROLLED STEEL SHEET, METHOD FOR PRODUCING FULL-HARD COLD-ROLLED STEEL SHEET, METHOD FOR PRODUCING HEAT-TREATED SHEET, METHOD FOR PRODUCING STEEL SHEET, AND METHOD FOR PRODUCING COATED STEEL SHEET

TECHNICAL FIELD

This application relates to a steel sheet, a coated steel sheet, a method for producing a hot-rolled steel sheet, a method for producing a full-hard cold-rolled steel sheet, a method for producing a heat-treated sheet, a method for producing a steel sheet, and a method for producing a coated steel sheet. The steel sheet of the disclosed embodiments has a tensile strength (TS) of 780 MPa or more and good bending fatigue properties. Thus, the steel sheet of the disclosed embodiments is suitable for a material for automotive frame members.

BACKGROUND

In recent years, there has been a trend toward an improvement in the fuel economy of automobiles in the entire automotive industry in order to reduce the amount of $CO_2$ emission in view of global environmental conservation. To improve the fuel economy of automobiles, it is most effective to reduce the weight of automobiles by reducing the thickness of parts used. Thus, the amounts of high-strength steel sheets used as materials for automobile parts have recently been increasing.

Automotive parts are repeatedly subjected to stress equal to or lower than the yield strength; thus, fatigue resistance properties (bending fatigue properties) are also important. To improve fatigue resistance properties, a microstructure having a low ferrite phase content and including a bainite phase and a martensite phase or tempered martensite phase is often designed. However, steel sheets having the designed microstructure suffer from inferior formability because of the low ferrite phase, which has good formability (workability). A technique has been reported in which fatigue resistance properties are improved while a ferrite phase is contained.

For example, Patent Literature 1 discloses a hot-dip galvanized steel sheet having good stretch-flangeability and good resistance to cold-work embrittlement, the steel sheet containing, on a percent by mass basis, C: 0.03% to 0.13%, Si≤0.7%, Mn: 2.0% to 4.0%, P≤0.05%, S≤0.005%, Sol. Al: 0.01% to 0.1%, N≤0.005%, Ti: 0.005% to 0.1%, and B: 0.0002% to 0.0040% and including a ferrite phase that has an average grain size of 5 μm or less and a martensite phase that has a volume percentage of 15% to 80%.

Patent Literature 2 discloses a high-tensile hot-dip galvanized steel sheet having good bending fatigue properties at the time of notch bending, the steel sheet containing, on a percent by mass basis, C: more than 0.02% and 0.20% or less, Si: 0.01% to 2.0%, Mn: 0.1% to 3.0%, P: 0.003% to 0.10%, S: 0.020% or less, Al: 0.001% to 1.0%, N: 0.0004% to 0.015%, and Ti: 0.03% to 0.2%, the balance being Fe and incidental impurities, in which a metal microstructure of the steel sheet has, on an area percentage basis, a ferrite content of 30% to 95%, a second phase of the balance includes one or two or more of martensite, bainite, pearlite, cementite, and retained austenite, the area percentage of martensite is 0% to 50% if martensite is included, and the steel sheet contains a Ti-based carbonitride having a particle size of 2 to 30 nm at an average interparticle distance of 30 to 300 nm and contains a crystallized TiN having a particle size of 3 μm or more at an average interparticle diameter of 50 to 500 μm.

Patent Literature 3 discloses a hot-dip galvanized steel sheet having high fatigue strength, containing, on a percent by mass basis, C: 0.05% to 0.30%, Mn: 0.8% to 3.00%, P: 0.003% to 0.100%, S: 0.010% or less, Al: 0.10% to 2.50%, Cr: 0.03% to 0.50%, and N: 0.007% or less, including a ferrite phase, a retained austenite phase, and a low-temperature transformation phase, and having, on a volume percentage basis, a ferrite phase fraction of 97% or less, in which the steel sheet with a fracture surface obtained by punching has high fatigue strength owing to the precipitation of AlN in regions extending from steel-sheet surfaces excluding a coated layer to a depth of 1 μm.

Patent Literature 4 discloses a steel sheet having a tensile strength of 980 MPa or more and good bending workability, the steel sheet containing, on a percent by mass basis, C: 0.1% to 0.2%, Si: 2.0% or less, Mn: 1.0% to 3.0%, P: 0.1% or less, S: 0.07% or less, Al: 1.0% or less, Cr: 0.1% to 3.0%, and N: 0.01% or less, the balance being Fe and incidental impurities, and having a steel microstructure that contains, on an area percentage basis, 20% to 60% ferrite, 40% to 80% martensite, 5% or less bainite, and 5% or less retained austenite, in which the ferrite has an average grain size of 8 μm or less, and auto-tempered martensite in which an iron-based carbide having a size of 5 to 500 nm is precipitated in an amount of $1\times10^5$ or more per square millimeter accounts for, on an area percentage basis, ¾ or more of the martensite.

Patent Literature 5 discloses a high-strength hot-dip galvanized steel sheet having a tensile strength of 980 MPa or more, good workability, weldability, and fatigue properties, the steel sheet having a composition containing, on a percent by mass basis, C: 0.05% or more and less than 0.12%, Si: 0.35% or more and less than 0.80%, Mn: 2.0% to 3.5%, P: 0.001% to 0.040%, S: 0.0001% to 0.0050%, Al: 0.005% to 0.1%, N: 0.0001% to 0.0060%, Cr: 0.01% to 0.5%, Ti: 0.010% to 0.080%, Nb: 0.010% to 0.080%, and B: 0.0001% to 0.0030%, the balance being Fe and incidental impurities, in which the steel sheet has a microstructure containing, on a volume fraction basis, 20% to 70% a ferrite phase having an average grain size of 5 μm or less, and the steel sheet has a hot-dip galvanized layer on steel-sheet surfaces in a coating weight of (per surface) 20 to 150 g/m$^2$.

CITATION LIST

Patent Literature

PTL 1: Japanese Unexamined Patent Application Publication No. 2004-211140

PTL 2: Japanese Unexamined Patent Application Publication No. 2006-63360

PTL 3: Japanese Unexamined Patent Application Publication No. 2007-262553

PTL 4: Japanese Unexamined Patent Application Publication No. 2010-275628

PTL 5: Japanese Unexamined Patent Application Publication No. 2010-542856

SUMMARY

Technical Problem

In the technique reported in Patent Literature 1, surface layer portions of the steel sheet to which the maximum stress is applied when the steel sheet is subjected to bending fatigue are not studied; thus, a steel sheet having good fatigue resistance properties cannot be obtained.

In the technique reported in Patent Literature 2, stress concentration occurs around the Ti-based carbonitride dispersed in a surface layer portion to lead to inferior fatigue resistance properties, in some cases.

In the technique reported in Patent Literature 3, in the case of a high tensile strength of 780 MPa or more, AlN dispersed in the surface layers encourages cracking during bending fatigue, and an air ratio of 1.0 or more is needed in order to disperse AlN. Thus, the surface layers are softened to degrade fatigue resistance properties.

The technique reported in Patent Literature 4 states that controlling the Si content and refining a bainite phase and/or a martensite phase enables the inhibition of the propagation of fatigue cracks. Regarding the formation of fatigue cracks, however, the formation of fatigue cracks from surface layer portions in the thickness direction is not studied. The formation of fatigue cracks can cause unanticipated defects in actual parts and the degradation of fatigue resistance properties due to local rust.

In the technique reported in Patent Literature 5, a hard Ti-containing carbonitride dispersed in order to maintain the hardness of surface layers causes the formation of cracks during bending fatigue, thereby degrading the fatigue resistance properties.

In any of these techniques in the related art, a difficulty lies in providing a steel sheet having a tensile strength of 780 MPa or more and good bending fatigue properties. The disclosed embodiments have been accomplished in light of these circumstances. It is an object of the disclosed embodiments to provide a steel sheet including a certain amount or more of a ferrite phase, having a low yield ratio, a tensile strength of 780 MPa or more, and good bending fatigue properties, a coated steel sheet, and production methods therefor. It is another object of the disclosed embodiments to provide a method for producing a hot-rolled steel sheet, a method for producing a full-hard cold-rolled steel sheet, and a method for producing heat-treated sheet required for the production of the steel sheet and the coated steel sheet.

Solution to Problem

To solve the foregoing problems, the inventors have conducted intensive studies on a steel sheet having a tensile strength of 780 MPa or more and good bending fatigue properties while including a ferrite phase.

To increase the strength, a method for incorporating a hard phase and a method for strengthening the ferrite phase with precipitates were studied. It was found that when attempts were made to increase the strength with the precipitates, stress concentration occurred around the precipitates to degrade the bending fatigue properties.

Thus, attempts were made to increase the strength with the hard phase. However, it was found that the use of a bainite phase and a tempered martensite phase resulted in insufficient strength and variations in strength.

To substantially increase the strength, an as-quenched martensite phase in which no carbide was observed with at least a scanning electron microscope (hereinafter, referred to as a martensite phase) was used. The evaluation of the bending fatigue properties of a dual-phase microstructure steel including the ferrite phase and the martensite phase demonstrated that persistent slip bands are formed in coarse ferrite grains serving as most soft portions in surface portions (regions extending from steel-sheet surfaces to a depth of 20 μm in the thickness direction as described below) in the thickness direction and are cracked to degrade the bending fatigue properties. It is thus conceivable that fine ferrite grains of the surface layer portions will be important.

It was found that the surface layer portions of the steel-sheet surfaces were easily subjected to decarbonization and that the decarbonization promoted the coarsening of the ferrite grains and the formation of duplex grains. To inhibit decarbonization, i.e., to obtain uniform finer grain size of the ferrite grains, it was found that the control of the dew point during annealing was required. Furthermore, it was also found that internally oxidized layers inevitably formed during hot rolling were required to be removed and that the internally oxidized layers were required to be removed in a pickling line.

The foregoing findings have led to the completion of the disclosed embodiments. The outline thereof will be described below.

[1] A steel sheet includes a component composition containing, on a percent by mass basis, C: 0.04% or more and 0.18% or less, Si: 0.6% or less, Mn: 1.5% or more and 3.2% or less, P: 0.05% or less, S: 0.015% or less, Al: 0.08% or less, N: 0.0100% or less, Ti: 0.010% or more and 0.035% or less, and B: 0.0002% or more and 0.0030% or less, the balance being Fe and incidental impurities, and a steel microstructure having an area percentage of a ferrite phase of 20% or more and 80% or less and an area percentage of a martensite phase of 20% or more and 80% or less, the area percentage being determined by microstructure observation, in which the surface layer portion of the steel sheet has an average ferrite grain size of 5.0 μm or less and an inclusion density of 200 particles/$mm^2$ or less, and in which the steel sheet has a surface hardness of 95% or more when the steel sheet has a hardness of 100% at a position ½t (where t represents the thickness of the steel sheet) away from a surface of the steel sheet in the thickness direction, and the steel sheet has a tensile strength of 780 MPa or more.

[2] In the steel sheet described in [1], the component composition further contains, on a percent by mass basis, one or two or more of Cr: 0.001% or more and 0.8% or less, Mo: 0.001% or more and 0.5% or less, Sb: 0.001% or more and 0.2% or less, and Nb: 0.001% or more and 0.1% or less.

[3] In the steel sheet described in [1] or [2], the component composition further contains, on a percent by mass basis, 1.0% or less in total of one or more of REM, Cu, Ni, V, Sn, Mg, Ca, and Co.

[4] A coated steel sheet includes a coated layer on a surface of the high-strength steel sheet according to any one of [1] to [3].

[5] In the coated steel sheet described in [4], the coated layer is a hot-dip galvanized layer or a hot-dip galvannealed layer, and the coated layer contains Fe: 20.0% or less by mass, Al: 0.001% or more by mass and 1.0% or less by mass, and 0% or more by mass and 3.5% or less by mass in total of one or two or more selected from Pb, Sb, Si, Sn, Mg, Mn, Ni, Cr, Co, Ca, Cu, Li, Ti, Be, Bi, and REM, the balance being Zn and incidental impurities.

[6] A method for producing a hot-rolled steel sheet includes heating a steel having the component composition described in any of [1] to [3] to 1100° C. or higher and 1300° C. or lower and subjecting the steel to hot rolling including rough rolling and finish rolling, cooling, and coiling, in which the finishing entry temperature is 1050° C. or lower, the finishing delivery temperature is 820° C. or higher, the time from the completion of the finish rolling to the start of cooling is within 3 seconds, the average cooling rate until 600° C. is 30° C./s or more, and the coiling temperature is 350° C. or higher and 580° C. or lower.

[7] A method for producing a full-hard cold-rolled steel sheet includes subjecting a hot-rolled steel sheet produced by the production method described in [6] to pickling at a thickness reduction of 5 μm or more and 50 μm or less and after the pickling, subjecting the resulting steel sheet to cold rolling.

[8] A method for producing a steel sheet includes heating a full-hard cold-rolled steel sheet produced by the production method described in [7] to an annealing temperature of 780° C. or higher and 860° C. or lower and after the heating, cooling the resulting steel sheet to a cooling stop temperature of 250° C. or higher and 550° C. or lower at an average cooling rate of 20° C./s or more until 550° C., in which in a temperature range of 600° C. or higher, the dew point is −40° C. or lower.

[9] A method for producing a heat-treated sheet includes heating a full-hard cold-rolled steel sheet produced by the production method described in [7] to 780° C. or higher and 860° C. or lower and subjecting the resulting steel sheet to pickling at a thickness reduction of 2 μm or more and 30 μm or less.

[10] A method for producing a steel sheet includes heating a heat-treated sheet produced by the production method described in [9] to an annealing temperature of 720° C. or higher and 780° C. or lower and after the heating, cooling the resulting sheet to a cooling stop temperature of 250° C. or higher and 550° C. or lower at an average cooling rate of 20° C./s or more until 550° C., in which in a temperature range of 600° C. or higher, the dew point is −40° C. or lower.

[11] A method for producing a coated steel sheet includes coating a steel sheet produced by the production method described in [8] or [10].

Advantageous Effects

The steel sheet obtained in the disclosed embodiments includes a certain amount or more of a ferrite phase and has a high tensile strength (TS) of 780 MPa or more and good bending fatigue properties. The use of the coated steel sheet including the steel sheet for automotive parts achieves a further reduction in the weight of automotive parts.

The method for producing a hot-rolled steel sheet, the method for producing a full-hard cold-rolled steel sheet, and the method for producing a heat-treated sheet serve as methods for producing intermediate products used for the production of the good steel sheet and coated steel sheet described above and contribute to improvements in the properties of the steel sheet and the coated steel sheet.

DETAILED DESCRIPTION

The disclosed embodiments will be described below. The scope of this disclosure is not intended to be limited to any of the following specific embodiments.

The disclosed embodiments relate to a steel sheet, a coated steel sheet, a method for producing a hot-rolled steel sheet, a method for producing a full-hard cold-rolled steel sheet, a method for producing a heat-treated sheet, a method for producing a steel sheet, and a method for producing a coated steel sheet. The relationship therebetween will first be described.

The steel sheet of the disclosed embodiments is not only a useful end product but also an intermediate product used for the production of the coated steel sheet of the disclosed embodiments. In the case of a method in which pretreatment heating and pickling are not performed after cold rolling, the coated steel sheet is produced from a steel such as a slab through processes for producing a hot-rolled steel sheet, a full-hard cold-rolled steel sheet, and a steel sheet. In the case of a method in which pretreatment heating and pickling are performed after cold rolling, the coated steel sheet is produced from a steel such as a slab through processes for producing a hot-rolled steel sheet, a full-hard cold-rolled steel sheet, a heat-treated sheet, and a steel sheet.

The method of the disclosed embodiments for producing a hot-rolled steel sheet is a process for producing a hot-rolled steel sheet among the foregoing processes.

The method of the disclosed embodiments for producing a full-hard cold-rolled steel sheet is a process for producing a full-hard cold-rolled steel sheet from a hot-rolled steel sheet among the foregoing processes.

The method of the disclosed embodiments for producing a heat-treated sheet is a process for producing a heat-treated sheet from a full-hard cold-rolled steel sheet among the foregoing processes in the case where the method includes performing pretreatment heating and pickling after cold rolling.

The method of the disclosed embodiments for producing a steel sheet is a process for producing a steel sheet from a full-hard cold-rolled steel sheet among the foregoing processes in the case where the method includes performing pretreatment heating and pickling after cold rolling, or is a process for producing a steel sheet from a heat-treated sheet in the case where the method does not include performing pretreatment heating and pickling after cold rolling.

The method of the disclosed embodiments for producing a coated steel sheet is a process for producing a coated steel sheet from a steel sheet among the foregoing processes.

Because of the foregoing relationship, the hot-rolled steel sheet, the full-hard cold-rolled steel sheet, the heat-treated sheet, the steel sheet, and the coated steel sheet share a common component composition, and the steel sheet and the coated steel sheet share a common steel microstructure. Hereinafter, a common item, the steel sheet, the coated steel sheet, and the production methods will be described in this order. Features concerning the surface hardness of the steel sheet are maintained in the coated steel sheet (regarding the surface hardness, a steel sheet obtained by removing the coating from the coated steel sheet also has the same features as the steel sheet before coating by controlling the dew point during annealing).

<Component Composition>

The steel sheet and so forth of the disclosed embodiments have a component composition containing, on a percent by mass basis, C: 0.04% or more and 0.18% or less, Si: 0.6% or less, Mn: 1.5% or more and 3.2% or less, P: 0.05% or less, S: 0.015% or less, Al: 0.08% or less, N: 0.0100% or less, Ti: 0.010% or more and 0.035% or less, and B: 0.0002% or more and 0.0030% or less, the balance being Fe and incidental impurities.

The component composition may further contain, on a percent by mass basis, one or two or more of Cr: 0.001% or more and 0.8% or less, Mo: 0.001% or more and 0.5% or less, Sb: 0.001% or more and 0.2% or less, and Nb: 0.001% or more and 0.1% or less.

The component composition may further contain, on a percent by mass basis, 1.0% or less in total of one or more of REM, Cu, Ni, Nb, V, Sn, Mg, Ca, and Co.

These components will be described below. In the following description, the symbol "%" that expresses the content of an element refers to "% by mass".

C: 0.04% or More and 0.18% or Less

C is an element that increases the hardness of a martensite phase to contribute to an increase in the strength of the steel sheet. To provide a tensile strength of 780 MPa or more, the C content needs to be at least 0.04% or more. A C content of more than 0.18% results in an excessive increase in the hardness of the martensite phase and the occurrence of stress concentration during bending fatigue due to the difference in hardness between a ferrite phase and the martensite phase, thereby degrading the bending fatigue properties. Thus, the C content is 0.18% or less. The lower limit of the C content is preferably 0.05% or more. The upper limit of the C content is preferably 0.16% or less.

Si: 0.6% or Less

Si hardens the ferrite phase and reduces the difference in hardness between the ferrite phase and the martensite phase. This can inhibit the occurrence of stress concentration during bending fatigue. From this point of view, the Si content is preferably 0.1% or more. Si forms a Si-containing oxide on surfaces of the steel sheet to degrade the bending fatigue properties, chemical conversion treatability, and coatability. From this point of view, because a Si content of up to 0.6% may be acceptable in the disclosed embodiments, the upper limit of the Si content is 0.6%, preferably 0.45% or less. The lower limit thereof is not particularly set and includes 0%; however, Si can be inevitably incorporated in steel in a content of 0.001% in view of the production. Thus, the lower limit is, for example, 0.001% or more.

Mn: 1.5% or More and 3.2% or Less

Mn is an element that reduces the temperature of transformation from the ferrite phase to the austenite phase to contribute to the formation of the martensite phase. To obtain a desired area percentage of the martensite phase, the Mn content needs to be at least 1.5% or more. A Mn content of more than 3.2% results in a microlevel segregation of Mn to degrade the bending fatigue properties. Thus, the Mn content is 1.5% or more and 3.2% or less. The lower limit of the Mn content is preferably 1.7% or more. The upper limit of the Mn content is preferably 3.0% or less.

P: 0.05% or Less

P is an element that segregates at grain boundaries to degrade the bending fatigue properties. Thus, the P content is preferably minimized as much as possible. A P content of up to 0.05% may be acceptable in the disclosed embodiments. The P content is preferably 0.04% or less. Although the P content is preferably minimized as much as possible, P can be inevitably incorporated in a content of 0.001% in view of the production. Thus, the lower limit thereof is, for example, 0.001% or more.

S: 0.015% or Less

S forms coarse MnS in steel, and the coarse MnS acts as a ferrite nucleation site during hot rolling. The nucleation of ferrite is promoted to initiate the transformation from the austenite phase to the ferrite phase at a high temperature, thus providing the steel sheet including fine ferrite grains required for the disclosed embodiments. To provide this effect, the S content is preferably 0.0005% or more, more preferably 0.003% or more. A S content of more than 0.015% results in the degradation of workability due to MnS. Thus, the upper limit of the S content is 0.015%, preferably 0.010% or less.

Al: 0.08% or Less

In the case where Al is added as a deoxidizer at the stage of steel making, the Al content is preferably 0.01% or more. More preferably, the Al content is 0.02% or more. Al forms an oxide that degrades workability. Thus, the upper limit of the Al content is 0.08%, preferably 0.07% or less.

N: 0.0100% or Less

N is a harmful element because N in a solid solution state degrades the aging resistance and because N in the form of a nitride acts as a site at which stress concentration occurs during bending fatigue. Thus, the N content is preferably minimized as much as possible. A N content of up to 0.0100% may be acceptable in the disclosed embodiments. The N content is preferably 0.0060% or less. Although the N content is preferably minimized as much as possible, N can be inevitably incorporated in a content of 0.0005% in view of the production. Thus, the lower limit thereof is, for example, 0.0005% or more.

Ti: 0.010% or More and 0.035% or Less

Ti is an element that immobilizes N in the form of a nitride to inhibit the formation of a B-containing nitride and that is effective in promoting the effect of B on an improvement in hardenability. Because N is inevitably incorporated, the Ti content needs to be 0.010% or more. At a Ti content of more than 0.035%, the degradation of bending fatigue properties due to a Ti-containing carbonitride becomes apparent. Thus, the Ti content is 0.010% or more and 0.035% or less. The lower limit of the Ti content is preferably 0.015% or more. The upper limit of the Ti content is preferably 0.030% or less. In particular, dissolved N has an adverse effect; thus, expression (1) is more preferably satisfied. When expression (1) is satisfied, the average ferrite grain size in surface layer portions is reduced to markedly improve the bending fatigue properties. To further increase the bending fatigue strength ratio to 0.74 or more, expression (1) is preferably satisfied.

$$2.95 \geq [\%\ Ti]/3.4[\%\ N] \geq 1.00 \quad (1)$$

where [% Ti] and [% N] represent the Ti content and the N content, respectively (% by mass).

B: 0.0002% or more and 0.0030% or less B is an element that improves the hardenability of the steel sheet to contribute to the refinement of the ferrite grains. When B is excessively contained, the bending fatigue properties are degraded by the effect of dissolved B. Thus, the B content is 0.0002% or more and 0.0030% or less. The lower limit of the B content is preferably 0.0005% or more. The upper limit of the B content is preferably 0.0020% or less.

The foregoing components are fundamental components of the disclosed embodiments. The component composition may further contain, on a percent by mass basis, one or two or more of Cr: 0.001% or more and 0.8% or less, Mo: 0.001% or more and 0.5% or less, Sb: 0.001% or more and 0.2% or less, and Nb: 0.001% or more and 0.1% or less.

Cr and Mo are effective in refining the ferrite grains because they contribute to an increase in the strength of the steel sheet by solid-solution strengthening and because they improve the hardenability of the steel sheet. To provide these effects, the Cr content needs to be 0.001% or more, and the Mo content needs to be 0.001% or more. A Cr content of more than 0.8% results in the degradation of surface properties to degrade the chemical conversion treatability and coatability. A Mo content of more than 0.5% results in a significant change in the transformation temperature of the steel sheet to cause the microstructure to deviate from a microstructure required in the disclosed embodiments, thereby degrading the bending fatigue properties. Sb is an element that concentrates on surfaces to contribute to the inhibition of surface decarbonization of the steel sheet and that can stably refine the ferrite grains in the surface layer portions of the steel sheet. To provide the effects, the Sb content needs to be 0.001% or more. An Sb content of more than 0.2% results in the degradation of the surface properties to degrade the chemical conversion treatability and coatability. Nb is an element useful in refining the crystal grains. To provide the effect, the Nb content needs to be 0.001% or more. An excessive Nb content results in the formation of a coarse carbonitride containing Nb to degrade the bending fatigue properties. Thus, the upper limit of the Nb content is 0.1%. From the points of view, the Cr content is 0.001% or more and 0.8% or less, the Mo content is 0.001% or more and 0.5% or less, the Sb content is 0.001% or more and 0.2% or less, and the Nb content is 0.001% or more and 0.1% or less. The lower limit of the Cr content is preferably 0.01% or more. The upper limit of the Cr content is preferably 0.7% or less. The lower limit of the Mo content is preferably 0.01% or more. The upper limit of the Mo content is preferably 0.3% or less. The lower limit of the Sb content is preferably 0.001% or more. The upper limit of the Sb content is preferably 0.05% or less. The lower limit of the Nb content is preferably 0.003% or more. The upper limit of the Nb content is preferably 0.07% or less.

The component composition may further contain 1.0% or less in total of one or more of REM, Cu, Ni, V, Sn, Mg, Ca, and Co. These elements are incorporated as incidental impurities. From the points of view of workability (formability) and aging resistance, 1.0% or less in total thereof may be acceptable. Preferably, the total content thereof is preferably 0.2% or less. From the points of view of workability (formability) and aging resistance, the lower limit of the total content of one or more thereof is preferably 0.01% or more.

Components other the foregoing components are Fe and incidental impurities. Even if the contents of Cr, Mo, Sb, and Nb are less than the respective lower limits, the effects of the disclosed embodiments are not impaired. When these elements are contained in contents of less than their lower limits, these elements are regarded as incidental impurities.

<Steel Microstructure>

The steel microstructure of the steel sheet and so forth of the disclosed embodiments will be described below. The steel microstructure of the steel sheet and so forth of the disclosed embodiments has an area percentage of a ferrite phase of 20% or more and 80% or less and an area percentage of a martensite phase of 20% or more and 80% or less, the area percentage being determined by microstructure observation, in which surface layer portions of the steel sheet have an average ferrite grain size of 5.0 μm or less and an inclusion density of 200 particles/mm$^2$ or less. The area percentage, the average ferrite grain size, and the inclusion density indicate values obtained by methods described in examples.

Area Percentage of Ferrite Phase: 20% or More and 80% or Less

The ferrite phase has good workability and is soft; thus, the ferrite phase can reduce the yield strength. To provide the workability and the yield strength required in the disclosed embodiments, the area percentage of the ferrite phase is 20% or more. If the ferrite phase is excessively increased, a tensile strength of 780 MPa cannot be obtained. Thus, the area percentage of the ferrite phase is 20% or more and 80% or less. The lower limit of the area percentage of the ferrite phase is preferably 30% or more. The upper limit of the area percentage of the ferrite phase is preferably 70% or less.

Area Percentage of Martensite Phase: 20% or More and 80% or Less

The martensite phase has high hardness and thus contributes to an increase in the strength of the steel sheet. To obtain a tensile strength of 780 MPa or more, the area percentage of the martensite phase needs to be 20% or more. An area percentage of the martensite phase of more than 80% results in low workability; thus, the steel sheet is not appropriate for automotive parts. Accordingly, the area percentage of the martensite phase is 80% or less. The lower limit of the area percentage of the martensite phase is preferably 30% or more. The upper limit of the area percentage of the martensite phase is preferably 70% or less.

As described above, ferrite and martensite are important for the steel microstructure. The total area percentage thereof is preferably 85% or more.

The remainder includes a bainite phase, a tempered martensite phase, and a retained austenite phase. The bainite phase and the tempered martensite phase decrease the strength and the material stability and thus are preferably minimized as much as possible. A total area percentage of the bainite phase and the tempered martensite phase of up to 15% may be acceptable in the disclosed embodiments. The total area percentage thereof is more preferably 10% or less. A large amount of retained austenite is not formed in the disclosed embodiments. The area percentage of the retained austenite is up to 4%.

Average Ferrite Grain Size in Surface Layer Portion of Steel Sheet: 5.0 μm or Less A maximum load stress is impressed on the surface layer portions of the steel sheet in the thickness direction during bending fatigue. To improve the bending fatigue properties, the surface layer portions need to be controlled rather than a middle portion in the thickness direction and near the middle portion. As described above, the microstructure of the surface layer portions can be changed by the formation of internally oxidized layers (oxide layers formed inside the surfaces, at least parts of thereof being present in regions extending from the surfaces to a depth of 20 μm) during hot rolling, decarbonization with scale formed during hot rolling, and decarbonization with water in a furnace during annealing. In order not to degrade the bending fatigue properties, the regions extending from the surfaces of the steel sheet to a depth of 20 μm may be controlled. The regions are defined as "surface layer portions of the steel sheet (steel-sheet surface layer portions)". In the case where coarse ferrite grains are present in the surface layer portions of the steel sheet, strain is concentrated on the coarse ferrite grains to form persistent slip bands that cause cracking during bending fatigue, thereby degrading the bending fatigue properties. To inhibit the adverse effect, the surface layer portions of the steel sheet need to have an average ferrite grain size of 5.0 μm or less, preferably 3.5 μm or less. The lower limit of the average ferrite grain size obtained in the disclosed embodiments is about 0.5 μm.

Inclusion Density in Surface Layer Portion of Steel Sheet: 200 Particles/mm$^2$ or Less Because inclusions present in the surface layer portions of the steel sheet cause cracking, the amount of the inclusions is preferably minimized as much as possible. An inclusion density of up to 200 particles/mm$^2$ may be acceptable in the disclosed embodiments. Preferably, the inclusion density is 150 particles/mm$^2$ or less.

<Properties>

The properties of the steel sheet and so forth of the disclosed embodiments will be described below. In the steel sheet and so forth of the disclosed embodiments, the steel sheet has a surface hardness of 95% or more when the steel sheet has a hardness of 100% at a position ½t (where t represents the thickness of the steel sheet) away from a surface of the steel sheet in the thickness direction (hardness in the middle portion of the steel sheet).

Surface Hardness of Steel Sheet≥Hardness of Middle Portion of Steel Sheet×0.95

The bending fatigue properties also depend on the hardness of the surface layers. If the surface hardness of the steel sheet, which indicates the hardness of the surface layers of the steel sheet, is lower than 95% of the hardness of the middle portion, the fatigue strength ratio (=fatigue strength/tensile strength) is decreased. To avoid the adverse effect, the surface hardness of the steel sheet needs to be 95% or more, preferably 97% or more, of the hardness of the middle portion.

<Steel Sheet>

The component composition and the steel microstructure of the steel sheet are as described above. The thickness of the steel sheet is not particularly limited; however, because of an increase in the tension of the steel sheet and the degradation of productivity during annealing, the thickness is preferably 3.2 mm or less. Usually, the thickness is 0.8 mm or more.

<Coated Steel Sheet>

The coated steel sheet of the disclosed embodiments includes the steel sheet of the disclosed embodiments and a coated layer provided on surfaces thereof.

The component composition and the steel microstructure of the steel sheet are as described above; thus, the description is omitted.

The coated layer will be described below. The coated layer of the coated steel sheet of the disclosed embodiments is not particularly limited. Examples thereof include hot-dip coated layers and electroplated layers. The hot-dip coated layers include alloyed layers. The coated layer is preferably a galvanized layer. The galvanized layer may contain Al and Mg. In addition, hot-dip zinc-aluminum-magnesium alloy coating (a Zn—Al—Mg coated layer) is also preferred. In this case, the coated layer preferably has an Al content of 1% or more by mass and 22% or less by mass and a Mg content of 0.1% or more by mass and 10% or less by mass, the remainder being Zn. In addition to Zn, Al, and Mg, the Zn—Al—Mg coated layer may contain 1% or less by mass in total of one or more selected from Si, Ni, Ce, and La. The coating metal is not particularly limited. Thus, for example, Al coating other than Zn coating as described above may be used.

A component contained in the coated layer is not particularly limited. A common component may be used. For example, in the case of a hot-dip galvanized layer or a hot-dip galvannealed layer, the coated layer is a hot-dip galvanized layer or a hot-dip galvannealed layer containing, on a percent by mass basis, Fe: 20.0% or less by mass, Al: 0.001% or more by mass and 1.0% or less by mass, and 0% or more by mass and 3.5% or less by mass in total of one or two or more selected from Pb, Sb, Si, Sn, Mg, Mn, Ni, Cr, Co, Ca, Cu, Li, Ti, Be, Bi, and REM, the balance being Zn and incidental impurities. Usually, the hot-dip galvanized layer has an Fe content of 0 to 5.0% by mass, and the hot-dip galvannealed steel sheet has an Fe content of more than 5.0% by mass and 20.0% or less by mass.

The coating metal is not particularly limited. Thus, for example, Al coating other than Zn coating as described above may be used.

<Method for Producing Hot-Rolled Steel Sheet>

Production methods will be described below in order from a method for producing a hot-rolled steel sheet. In the following description, a temperature indicates the surface temperature of a steel sheet, unless otherwise specified. The surface temperature of the steel sheet can be measured with a radiation thermometer or the like. The average cooling rate is defined as ((surface temperature before cooling−surface temperature after cooling)/cooling time).

The method for producing a hot-rolled steel sheet includes heating a steel having the foregoing component composition to 1100° C. or higher and 1300° C. or lower and subjecting the steel to hot rolling including rough rolling and finish rolling, in which the finishing entry temperature is 1050° C. or lower, the finishing delivery temperature is 820° C. or higher, the time from the completion of the finish rolling to the start of cooling is within 3 seconds, cooling is performed at an average cooling rate of 30° C./s or more until 600° C., and the resulting steel sheet is coiled at 350° C. or higher and 580° C. or lower.

An ingot-forming method for the production of the steel described above is not particularly limited, and a known ingot-forming method using a converter or an electric furnace may be employed. Secondary refining may be performed in a vacuum degassing furnace. Then a slab (steel) is preferably formed by a continuous casting process in view of productivity and quality. The slab may also be formed by a known casting process such as an ingot-casting and slabbing-rolling process or a thin slab continuous casting process.

Heating Temperature of Steel: 1100° C. or Higher and 1300° C. or Lower

In the disclosed embodiments, the steel needs to be heated to form the steel microstructure of the steel into a substantially uniform austenite phase before the rough rolling. To complete the finish rolling at 820° C. or higher, the heating temperature needs to be 1100° C. or higher. If the heating temperature is higher than 1300° C., the internally oxidized layers formed in the surface layer portions of the steel sheet are too thick to be removed by pickling, thus degrading the bending fatigue properties. Accordingly, the heating temperature of the steel is 1100° C. or higher and 1300° C. or lower. The lower limit of the heating temperature is preferably 1,120° C. or higher. The upper limit of the heating temperature is preferably 1260° C. or lower. Conditions of the rough rolling after the heating are not particularly limited.

Finishing Entry Temperature: 1050° C. or lower

Finishing Delivery Temperature: 820° C. or higher

Although scale is removed on the entry side of a finisher, scale and internally oxidized layers formed during finish rolling adversely affect the bending fatigue properties. Because the amounts of scale and internally oxidized layers depend on the temperature, the rolling needs to be initiated at a temperature as low as possible. A higher temperature of the finish rolling tends to increase the size of the ferrite grains. A heating temperature of up to 1050° C. may be acceptable in the disclosed embodiments. Thus, the finishing entry temperature is 1050° C. or lower. The lower limit of the finishing entry temperature is preferably 1000° C. or higher. A finishing delivery temperature of lower than 820° C. results in the promotion of the transformation from the austenite phase to the ferrite phase during rolling to increase variations in the strength of the surfaces of the steel sheet, thereby markedly degrading the cold rollability and causing troubles such as the breaking of the sheet during cold rolling. Thus, the finishing delivery temperature is 820° C. or higher. The upper limit of the finishing delivery temperature is preferably 900° C. or lower.

Time from Completion of Finish Rolling to Start of Cooling: Within 3 Seconds (Including 0 Seconds)

Average cooling rate until 600° C.: 30 OC/s or more

To inhibit the formation of scale and an internally oxidized layer, the cooling needs to be started as soon as possible after the finish rolling. Also from the viewpoint of inhibiting the coarsening of the ferrite grains, a shorter time until the start of the cooling is preferred. A time of up to 3 seconds may be acceptable in the disclosed embodiments. Thus, the elapsed time from the completion of the finish rolling to the start of the cooling is within 3 seconds. In the case of a low average cooling rate during the cooling, scale is formed because of a large amount of time that the steel sheet is exposed to the high temperatures. Furthermore, the ferrite grains tend to coarsen. The formation of scale proceeds at 600° C. or higher in a short time. To inhibit this formation, the average cooling rate from the start of the cooling to 600° C. during the cooling is 30° C./s or more. Preferably, the cooling is started within 2 seconds thereafter and is performed at an average cooling rate of 35 OC/s or more until 580° C. The cooling stop temperature is roughly equal to the finishing delivery temperature (the temperature is only slightly decreased within 3 seconds, which is the time from the completion of the finish rolling to the start of the cooling). The cooling stop temperature is usually a coiling temperature described below. The average cooling rate from 600° C. to the coiling temperature (in a preferred range, the average cooling rate from 580° C. to the coiling temperature) is not particularly limited and may be 30 OC/s or more or may be less than 30 OC/s.

Coiling Temperature: 350° C. or Higher and 580° C. or Lower

The cooling of the coiled steel sheet to room temperature requires at least 1 hour or more. To inhibit the formation of an internally oxidized layer and scale during this time and reduce the inclusion density, the coiling temperature needs to be 580° C. or lower. A coiling temperature of lower than 350° C. results in the degradation of the shape of the sheet to lead to the cold rollability. Thus, the coiling temperature is 350° C. or higher and 580° C. or lower. The lower limit of the coiling temperature is preferably 400° C. or higher. The upper limit of the coiling temperature is preferably 550° C. or lower.

After the coiling, the steel sheet is cooled by, for example, air cooling and then is used for the production of the full-hard cold-rolled steel sheet described below. In the case where the hot-rolled steel sheet is treated as merchandise to be sold as an intermediate product, usually, the hot-rolled steel sheet in a state of being cooled after the coiling is treated as merchandise to be sold.

<Method for Producing Full-Hard Cold-Rolled Steel Sheet>

The method for producing a full-hard cold-rolled steel sheet includes subjecting a hot-rolled steel sheet produced by the foregoing method to pickling at a thickness reduction of 5 μm or more and 50 μm or less and after the pickling, subjecting the resulting steel sheet to cold rolling.

Reduction in Thickness: 5 μm or More and 50 μm or Less

The decarbonized layers with the internally oxidized layer and scale inevitably formed in the production of the hot-rolled steel sheet needs to be removed from the viewpoint of improving the bending fatigue properties. Also from the viewpoint of reducing the inclusion density, pickling needs to be performed at a certain level or higher of a reduction in thickness. To improve the bending fatigue properties, a thickness of at least 5 μm or more needs to be reduced by the pickling. A thickness reduction of more than 50 μm results in the degradation of the roughness of the surfaces of the steel sheet to adversely affect the cold rollability. Thus, the reduction in thickness by the pickling is 5 μm or more and 50 μm or less. The lower limit of the reduction in thickness is preferably 10 μm or more. The upper limit of the reduction in thickness is preferably 40 μm or less.

Cold Rolling

To obtain a desired thickness, the hot-rolled sheet (hot-rolled steel sheet) after the pickling needs to be subjected to cold rolling. The reduction ratio in the cold rolling is not particularly limited. Usually, the lower limit thereof is 30% or more, and the upper limit thereof is 95% or less.

<Method for Producing Steel Sheet>

As a method for producing a steel sheet, there are a method for producing a steel sheet by subjecting a full-hard cold-rolled steel sheet to heating and cooling; and a method for producing a steel sheet by subjecting a full-hard cold-rolled steel sheet to pretreatment heating and pickling to form a heat-treated sheet and subjecting the heat-treated sheet to heating and cooling. First, a method that does not include pretreatment heating or pickling will be described.

A method for producing a steel sheet without performing pretreatment heating or pickling includes heating the full-hard cold-rolled steel sheet produced as described above to an annealing temperature of 780° C. or higher and 860° C. or lower and after the heating, cooling the resulting steel sheet to a cooling stop temperature of 250° C. or higher and 550° C. or lower at an average cooling rate of 20° C./s or more until 550° C., in which in a temperature range of 600° C. or higher during the heating and the cooling described above, a dew point is −40° C. or lower.

Annealing Temperature: 780° C. or Higher and 860° C. or Lower

In annealing, the ferrite phase is required to be left while strain due to the cold rolling is eliminated. An annealing temperature of lower than 780° C. results in the failure of the removal of the strain due to the cold rolling to markedly decrease the ductility; thus, the steel sheet is not appropriate for automotive parts. An annealing temperature of higher than 860° C. results in the removal of the ferrite phase to degrade the workability. Thus, the annealing temperature is 780° C. or higher and 860° C. or lower. The lower limit of the annealing temperature is preferably 790° C. or more. The upper limit of the annealing temperature is preferably 850° C. or lower. Usually, the steel sheet is soaked at a predetermined annealing temperature and then cooled under the following conditions.

Average Cooling Rate until 550° C.: 20° C./s or more

Cooling Stop Temperature: 250° C. or higher and 550° C. or lower

After the heating at the annealing temperature, there is a need to inhibit ferrite grain growth by rapid cooling. To inhibit the ferrite grain growth, the average cooling rate until 550° C. needs to be 20° C./s or more. The upper limit thereof is preferably 100° C./s or less. At 550° C. or higher, the ferrite grains can grow. Thus, the temperature range in which the average cooling rate is adjusted is up to 550° C., and the upper limit of the cooling stop temperature is 550° C. Preferably, the temperature range in which the average cooling rate is adjusted is up to 530° C., and the upper limit of the cooling stop temperature is 530° C. A cooling stop temperature of lower than 250° C. results in the degradation of the shape of the steel sheet; thus, the steel sheet is not appropriate for a product. Accordingly, the cooling stop temperature is 250° C. or higher, preferably 300° C. or higher. The average cooling rate from 550° C. to the cooling stop temperature is not particularly limited and may be 20 OC/s or more or may be less than 20 OC/s.

Dew Point in Temperature Range of 600° C. or Higher: −40° C. or Lower

In a temperature range of 600° C. or higher during the annealing, a higher dew point results in the promotion of decarbonization with water in air to coarsen the ferrite grains in the surface layer portions of the steel sheet and to decrease the hardness, thus failing to stably obtain good tensile strength and degrading the bending fatigue properties. Accordingly, in the temperature of 600° C. or higher during the annealing, the dew point needs to be −40° C. or lower, preferably −45° C. or lower. In the case of usual annealing including heating, soaking, and cooling steps, in the temperature range of 600° C. or higher in all steps, the dew point needs to be −40° C. or lower. The lower limit of the dew point of the atmosphere is preferably, but not particularly limited to, −80° C. or higher because the effect is saturated at lower than −80° C., facing a cost disadvantage. The temperature in the temperature range is based on the surface temperature of the steel sheet. That is, when the surface temperature of the steel sheet is in the temperature range described above, the dew point is adjusted in the range described above.

Next, a method in which the steel sheet is subjected to pretreatment heating and pickling to form a heat-treated sheet and then a steel sheet is produced will be described.

Subjecting the full-hard cold-rolled steel sheet to the pretreatment heating and the pickling can eliminate strain due to the cold rolling. Thus, a lower annealing temperature can be used during the annealing to stably inhibit decarbonization from the surface layers.

In the pretreatment heating and the pickling, the steel sheet is heated to 780° C. or higher and 860° C. or lower, and the thickness thereof is reduced by 2 μm or more and 30 μm or less using the pickling.

A heating temperature in the pretreatment heating of lower than 780° C. results in the failure of the removal of strain due to the cold rolling. A heating temperature of higher than 860° C. results in significant damage to a furnace body in an annealing line to decrease the productivity. Thus, the heating temperature in the pretreatment heating is 780° C. or higher and 860° C. or lower. The lower limit of the heating temperature is preferably 790° C. or higher. The upper limit of the heating temperature is preferably 850° C. or higher.

After the heating, the pickling is performed at a thickness reduction of 2 μm or more and 30 μm or less. To remove the internally oxidized layers and the decarbonized layers formed by the pretreatment heating, the pickling needs to be performed at a thickness reduction of 2 μm or more after the heating. At a thickness reduction of more than 30 μm, the crystal grains of the surface layers of the steel sheet come off easily with a roll during the annealing to degrade the surface properties of the steel sheet. Thus, the upper limit of the reduction in thickness is 30 μm. The lower limit of the reduction in thickness is preferably 5 μm or more. The upper limit of the reduction in thickness is preferably 25 μm or less.

The annealing is performed after the pickling. In this case, the annealing temperature is 720° C. or higher and 780° C. or lower. An annealing temperature of lower than 720° C. results in the meandering of the sheet during the passage of the sheet through the annealing line, leading to a decrease in productivity. An annealing temperature of higher than 780° C. results in the loss of an advantageous improvement in the cleanliness of the surface layer portions of the steel sheet owing to the pretreatment heating and the pickling. Thus, the annealing temperature is 720° C. or higher and 780° C. or lower. Conditions, such as the dew point, other than the annealing temperature are the same as those in the case where the pretreatment heating and the pickling are not performed; thus, the description is omitted.

<Method for Producing Coated Steel Sheet>

A method of the disclosed embodiments for producing a coated steel sheet is a method in which the steel sheet is subjected to coating. The type of coating treatment is not particularly limited. Examples thereof include hot-dip coating treatment and electroplating treatment. The hot-dip coating treatment may be treatment in which alloying is performed after hot-dip coating. Specifically, a coated layer may be formed by hot-dip galvanizing treatment or treatment in which alloying is performed after hot-dip galvanization. A coated layer may be formed by electroplating such as Zn—Ni alloy electroplating. Hot-dip zinc-aluminum-magnesium alloy coating may be performed. In the case where hot-dip coating, which is often used for automotive steel sheets, is performed, a coating layer may be formed on the surfaces by subjecting the steel sheet to the annealing in a continuous hot-dip coating line, cooling after the annealing, and immersion in a hot-dip coating bath. As described in the explanation of the coated layer, Zn coating is preferred; however, coating treatment using another metal, for example, Al coating, may be used.

Examples

Steels having component compositions given in Table 1 and having a thickness of 250 mm were subjected to hot rolling under hot-rolling conditions given in Tables 2 and 3 to form hot-rolled sheets (hot-rolled steel sheets). The hot-rolled sheets were subjected to pickling under conditions given in Tables 2 and 3, cold rolling under conditions given in Tables 2 and 3 to form cold-rolled sheets (full-hard cold-rolled steel sheets). Under annealing conditions given in Tables 2 and 3 (the production conditions given in Table 3 indicate production conditions for the production of heat-treated sheets and the annealing of the heat-treated sheets), cold-rolled steel sheets (CR materials) were subjected to annealing in a continuous annealing line, hot-dip coated steel sheets (GI materials) and hot-dip alloy-coated steel sheets (GA materials) were subjected to annealing in a continuous hot-dip coating line. In the production of the alloy-coated steel sheets, alloying treatment was performed after coating. The coating bath (coating composition: Zn-0.13% by mass Al) used in the continuous hot-dip coating line had a temperature of 460° C. The GI materials (hot-dip coated steel sheets) and the GA materials (hot-dip alloy-coated steel sheets) each had a coating weight of 45 $g/m^2$ or more and 65 $g/m^2$ or less per side. In the case of a hot-dip galvannealed layer, the galvannealed layer had an Fe content of 6% or more by mass and 14% or less by mass. In the case of a hot-dip galvanized layer, the galvanized layer had an Fe content of 4% or less by mass. The steel sheet had a thickness of 1.4 mm.

Test pieces were sampled from the steel sheets (the CR materials, the GI materials, and the GA materials) produced as described above and evaluated by methods described below.

(i) Microstructure Observation

The area percentages of phases were evaluated by a method described below. A test piece was cut out from each of the steel sheets in such a manner that a section of the test piece in the thickness direction, the section being parallel to the rolling direction, was an observation surface. The central portion was etched with 1% nital. Images of 10 fields of view of a portion of each steel sheet were photographed with a scanning electron microscope at a magnification of ×2,000, the portion being located away from a surface of the steel sheet by ¼ of the thickness of the steel sheet. A ferrite phase is a microstructure in which corrosion marks and cementite are not observed in grains. Martensite indicates a microstructure that appears as white grains and that no carbide is observed in the grains. The ferrite phase and the martensite phase were isolated from each other by image analysis, and the area percentages thereof were determined with respect to the field of view. In the case of including a bainite phase and a retained austenite phase other than the ferrite phase and martensite phase, the microstructures were symbolically represented in Table 3. Note that a tempered martensite was not observed under the annealing conditions given in Tables 2 and 3.

The ferrite grain size in surface layer portions of each steel sheet was determined as follows: A test piece was cut out from the steel sheet in such a manner that a section of the test piece in the thickness direction, the section being parallel to the rolling direction, was an observation surface. A region extending from a surface of the steel sheet (which is not a surface of the coated layer but a surface of a portion of the steel sheet) to a depth of 20 μm in the thickness direction was etched with 1% nital. Images of 10 fields of view of a surface layer portion of the steel sheet were photographed with a scanning electron microscope at a magnification of ×2,000. The ferrite grains in the photographed images were subjected to image analysis to determine the areas of the ferrite grains and to determine equivalent circle diameters corresponding to the areas. The average value of the equivalent circle diameters was regarded as average ferrite grain size, which is presented in Table 4.

The inclusion density of a surface layer portion of each of the steel sheets was determined as follows: A test piece was cut out from the steel sheet in such a manner that a section of the test piece in the thickness direction, the section being parallel to the rolling direction, was an observation surface. The observation surface, which was a region extending from a surface of the steel sheet (which is not a surface of the coated layer but a surface of a portion of the steel sheet) to a depth of 20 μm in the thickness direction, was mirror-polished. Then consecutive photographs of the surface layer portion of an actual length of 1 mm of the steel sheet were taken with an optical microscope at a magnification of ×400. The number of inclusions that appeared as dark portions was counted in a region extending from the surface of the steel sheet to a depth of 20 μm in the resulting photographs. The number was divided by the measurement area to determine the inclusion density.

(ii) Tensile Test

A JIS No. 5 tensile test piece was sampled from each of the resulting steel sheets in a direction perpendicular to the rolling direction. A tensile test according to JIS Z 2241 (2011) was performed five times. The average yield strength (yield strength) (YS), the tensile strength (TS), and the total elongation (El) were determined. The cross head speed was 10 mm/min in the tensile test. In Table 3, the steel sheets having a tensile strength of 780 MPa or more and a yield ratio (=yield strength/tensile strength) of 0.75 or less were regarded as those having mechanical properties required in the disclosed embodiments.

(iii) Bending Fatigue Properties

A 15-mm-width No. 1 test piece according to JIS Z 2275 was sampled from each of the resulting steel sheets in a direction perpendicular to the rolling direction. A plane bending fatigue test according to JIS Z 2273 was performed with a plane bending fatigue testing machine at a stress ratio of −1, a repetition rate of 20 Hz, and a maximum cycle number of $10^7$ cycles. When the test piece was not broken until $10^7$ cycles of stress addition, the stress amplitude was determined. The stress amplitude was divided by the tensile strength to determine the fatigue strength ratio. The fatigue strength ratio required in the disclosed embodiments was 0.70 or more.

(iv) Hardness

The hardnesses of a surface and an inner portion of each of the steel sheets were determined by the Vickers hardness test. The hardness of the surface of each steel sheet was determined as follows: When a coated layer was included, the steel sheet was subjected to pickling to remove the coated layer. Then the test was performed at a total of 20 points on the surface of the steel sheet at a test load of 0.2 kgf, and the average value was calculated. The hardness of the inner portion of each steel sheet was determined as follows: The test was performed at a total of five points in a portion of a section of the test piece parallel to the rolling direction at a test load of 1 kgf, the portion being located at a position ½ of the thickness of the steel sheet. Then the average value was calculated. The steel sheets having an average surface hardness of 95% or more (0.95 or more in the table) of the average hardness of the inner portion were regarded as those having properties required in the disclosed embodiments.

TABLE 1

| | Component composition (% by mass) | | | | | | | | | | | |
|---|---|---|---|---|---|---|---|---|---|---|---|---|
| Steel No. | C | Si | Mn | P | S | Al | N | Ti | B | Others | Expression (1) | Remarks |
| A | 0.062 | 0.11 | 2.26 | 0.02 | 0.001 | 0.03 | 0.0050 | 0.018 | 0.0009 | — | 1.06 | Example |
| B | 0.088 | 0.17 | 2.34 | 0.01 | 0.006 | 0.04 | 0.0041 | 0.015 | 0.0015 | Cr: 0.59<br>Mo: 0.09<br>Nb: 0.03 | 1.08 | Example |
| C | 0.140 | 0.23 | 2.89 | 0.01 | 0.010 | 0.05 | 0.0048 | 0.029 | 0.0016 | Sb: 0.02<br>Ni: 0.02<br>Cu: 0.04<br>REM: 0.002 | 1.78 | Example |
| D | 0.080 | 0.15 | 2.71 | 0.01 | 0.008 | 0.04 | 0.0043 | 0.020 | 0.0014 | Mo: 0.2<br>Sn: 0.001<br>Mg: 0.001<br>Co: 0.003 | 1.37 | Example |
| E | 0.120 | 0.43 | 2.55 | 0.01 | 0.007 | 0.05 | 0.0037 | 0.024 | 0.0006 | Cr: 0.55<br>Ca: 0.003 | 1.91 | Example |
| F | 0.085 | 0.03 | 1.85 | 0.02 | 0.007 | 0.03 | 0.0037 | 0.013 | 0.0009 | Mo: 0.18<br>V: 0.08 | 1.03 | Example |
| G | 0.030 | 0.26 | 2.11 | 0.01 | 0.010 | 0.03 | 0.0039 | 0.017 | 0.0011 | — | 1.28 | Comparative example |
| H | 0.190 | 0.15 | 2.35 | 0.01 | 0.007 | 0.05 | 0.0038 | 0.027 | 0.0019 | — | 2.09 | Comparative example |

TABLE 1-continued

| Steel No. | Component composition (% by mass) | | | | | | | | | | Expression (1) | Remarks |
|---|---|---|---|---|---|---|---|---|---|---|---|---|
| | C | Si | Mn | P | S | Al | N | Ti | B | Others | | |
| I | 0.092 | 0.35 | 1.35 | 0.02 | 0.010 | 0.05 | 0.0032 | 0.023 | 0.0014 | — | 2.11 | Comparative example |
| J | 0.093 | 0.17 | 3.64 | 0.01 | 0.006 | 0.04 | 0.0029 | 0.013 | 0.0009 | — | 1.32 | Comparative example |
| K | 0.077 | 0.10 | 2.15 | 0.02 | 0.006 | 0.03 | 0.0034 | 0.006 | 0.0017 | — | 0.52 | Comparative example |
| L | 0.073 | 0.32 | 2.38 | 0.01 | 0.007 | 0.03 | 0.0033 | 0.016 | 0.0001 | — | 1.43 | Comparative example |
| M | 0.075 | 0.15 | 2.31 | 0.01 | 0.009 | 0.05 | 0.0048 | 0.015 | 0.0016 | — | 0.92 | Example |

Expression (1): $2.95 \geq [\%\ Ti]/3.4[\%\ N] \geq 1.00$

TABLE 2

| | | Hot rolling step | | | | | | | | Annealing step | | | | | |
|---|---|---|---|---|---|---|---|---|---|---|---|---|---|---|---|
| Steel sheet No. | Steel | Slab heating temperature (° C.) | Finishing entry temperature (° C.) | Finishing delivery temperature (° C.) | Time from completion of finish rolling to starts of cooling (s) | Average cooling rate (° C./s) *1 | Coiling temperature (° C.) | Reduction in thickness (μm) *2 | Cold rolling reduction ratio (%) | Annealing temperature (° C.) | Dew point in temperature range of 600° C. or higher (° C.) | Cooling rate (° C./s) *3 | Cooling stop temperature (° C.) | Alloying temperature (° C.) | Remarks |
| 1 | A | 1250 | 1040 | 850 | 1.5 | 43 | 430 | 21 | 57 | 828 | −51 | 39 | 314 | — | Example |
| 2 | | 1200 | 1040 | 870 | 1.6 | 37 | 430 | 21 | 68 | 799 | −53 | 35 | 489 | — | Example |
| 3 | | 1230 | 1010 | 890 | 1.9 | 39 | 510 | 25 | 45 | 825 | −50 | 48 | 491 | 500 | Example |
| 4 | | 1210 | 1110 | 880 | 0.9 | 44 | 450 | 20 | 42 | 813 | −50 | 35 | 507 | 530 | Comparative example |
| 5 | | 1240 | 1030 | 870 | 5.6 | 46 | 570 | 21 | 58 | 821 | −49 | 30 | 498 | 500 | Comparative example |
| 6 | | 1240 | 1030 | 840 | 1.2 | 5 | 540 | 22 | 40 | 796 | −56 | 36 | 504 | 500 | Comparative example |
| 7 | | 1220 | 1000 | 850 | 1.4 | 38 | 680 | 28 | 44 | 817 | −46 | 28 | 483 | 540 | Comparative example |
| 8 | | 1200 | 1010 | 860 | 0.9 | 36 | 540 | 2 | 59 | 812 | −52 | 39 | 465 | 510 | Comparative example |
| 9 | | 1220 | 1000 | 890 | 1.9 | 36 | 520 | 26 | 50 | 875 | −55 | 28 | 484 | 510 | Comparative example |
| 10 | | 1220 | 1020 | 850 | 1.8 | 42 | 430 | 17 | 56 | 822 | −35 | 42 | 476 | 540 | Comparative example |
| 11 | | 1240 | 1000 | 880 | 1.3 | 38 | 430 | 30 | 48 | 821 | −52 | 14 | 501 | 520 | Comparative example |
| 12 | | 1230 | 1000 | 870 | 1.5 | 44 | 450 | 25 | 51 | 809 | −51 | 25 | 568 | 530 | Comparative example |
| 13 | B | 1200 | 1020 | 840 | 1.4 | 38 | 540 | 29 | 66 | 821 | −51 | 49 | 339 | — | Example |
| 14 | | 1210 | 1040 | 850 | 1.4 | 44 | 430 | 30 | 52 | 840 | −49 | 38 | 492 | — | Example |
| 15 | | 1250 | 1030 | 890 | 1.7 | 35 | 520 | 30 | 44 | 827 | −53 | 42 | 497 | 520 | Example |
| 16 | C | 1240 | 1040 | 840 | 1.5 | 39 | 540 | 16 | 56 | 821 | −49 | 25 | 344 | — | Example |
| 17 | | 1210 | 1000 | 850 | 1.3 | 43 | 410 | 18 | 54 | 817 | −46 | 40 | 465 | — | Example |
| 18 | | 1250 | 1000 | 870 | 1.8 | 49 | 420 | 19 | 60 | 811 | −53 | 47 | 477 | 520 | Example |
| 19 | D | 1230 | 1050 | 890 | 1.2 | 43 | 520 | 30 | 42 | 840 | −51 | 38 | 322 | — | Example |
| 20 | | 1250 | 1020 | 890 | 1.8 | 40 | 540 | 15 | 51 | 819 | −50 | 49 | 487 | — | Example |
| 21 | | 1230 | 1040 | 860 | 1.3 | 47 | 460 | 17 | 55 | 796 | −54 | 46 | 470 | 530 | Example |
| 22 | E | 1240 | 1000 | 840 | 1.8 | 42 | 470 | 29 | 65 | 820 | −49 | 50 | 303 | — | Example |
| 23 | | 1210 | 1040 | 870 | 1.3 | 46 | 480 | 24 | 52 | 837 | −52 | 29 | 475 | — | Example |
| 24 | | 1230 | 1030 | 850 | 1.1 | 50 | 410 | 23 | 62 | 813 | −55 | 31 | 485 | 510 | Example |
| 25 | F | 1210 | 1020 | 890 | 0.9 | 46 | 410 | 23 | 55 | 840 | −56 | 43 | 303 | — | Example |
| 26 | | 1250 | 1020 | 850 | 1.1 | 46 | 520 | 16 | 48 | 795 | −54 | 36 | 494 | — | Example |
| 27 | | 1200 | 1010 | 870 | 1.9 | 35 | 540 | 24 | 40 | 792 | −50 | 25 | 502 | 500 | Example |
| 28 | G | 1230 | 1010 | 850 | 1.6 | 37 | 460 | 28 | 62 | 840 | −46 | 30 | 486 | 520 | Comparative example |
| 29 | H | 1230 | 1010 | 840 | 1.7 | 42 | 530 | 17 | 66 | 836 | −48 | 33 | 503 | 540 | Comparative example |
| 30 | I | 1250 | 1040 | 880 | 1.9 | 43 | 510 | 28 | 48 | 834 | −55 | 49 | 472 | 500 | Comparative example |
| 31 | J | 1250 | 1040 | 880 | 1.6 | 41 | 460 | 15 | 56 | 831 | −54 | 44 | 478 | 540 | Comparative example |
| 32 | K | 1200 | 1020 | 880 | 0.9 | 46 | 410 | 22 | 48 | 838 | −48 | 44 | 483 | 510 | Comparative example |
| 33 | L | 1200 | 1000 | 870 | 1.3 | 50 | 460 | 28 | 52 | 824 | −48 | 38 | 471 | 520 | Comparative example |
| 34 | M | 1200 | 1010 | 880 | 1.2 | 55 | 480 | 25 | 50 | 836 | −51 | 40 | 493 | 530 | Example |

*1 Average cooling rate from cooling start temperature to 600° C.
*2 Reduction in thickness by passing sheet through pickling line
*3 Average cooling rate from annealing temperature to 550° C.

TABLE 3

| Steel sheet No. | Steel | Hot rolling step: Slab heating temperature (° C.) | Finishing entry temperature (° C.) | Finishing delivery temperature (° C.) | Time from completion of finish rolling to start of cooling (s) | Average cooling rate (° C./s) *1 | Coiling temperature (° C.) | Reduction in thickness (μm) *2 | Cold rolling reduction ratio (%) |
|---|---|---|---|---|---|---|---|---|---|
| 35 | A | 1220 | 1010 | 870 | 1.00 | 48 | 410 | 18 | 58 |
| 36 | | 1230 | 1050 | 840 | 1.00 | 43 | 500 | 30 | 61 |
| 37 | | 1200 | 1040 | 860 | 1.30 | 38 | 480 | 14 | 58 |

| Steel sheet No. | Heating temperature (° C.) *3 | Reduction in thickness (μm) *4 | Annealing step: Annealing temperature (° C.) | Dew point in temperature range of 600° C. or higher (° C.) | Cooling rate (° C./s) *5 | Cooling stop temperature (° C.) | Alloying temperature (° C.) | Remarks |
|---|---|---|---|---|---|---|---|---|
| 35 | 816 | 8 | 759 | −48 | 25 | 323 | — | Example |
| 36 | 798 | 14 | 772 | −51 | 35 | 482 | — | Example |
| 37 | 825 | 7 | 774 | −55 | 47 | 468 | 530 | Example |

*1 Average cooling rate from cooling start temperature to 600° C.
*2 Reduction in thickness by passing sheet through pickling line
*3 Heating temperature in pretreatment heating and pickling step
*4 Reduction in thickness in pretreatment heating and pickling step
*5 Average cooling rate from annealing temperature to 550° C.

TABLE 4

| | | Microstructure of steel sheet | | | | | Mechanical properties of steel sheet | | | | | | |
|---|---|---|---|---|---|---|---|---|---|---|---|---|---|
| Steel sheet No. | Surface state | Area percentage of martensite (%) | Area percentage of ferrite (%) | Metal microstructure *1 | Grain size of ferrite in surface layer (μm) *2 | Inclusion density in surface layer (particles/mm$^2$) *3 | Yield strength (MPa) | Tensile strength (MPa) | Yield ratio | Elongation (%) | Hardness of surface layer/ hardness of middle | Fatigue strength ratio | Remarks |
| 1 | CR material | 33 | 62 | F + M + B | 2.1 | 66 | 576 | 800 | 0.72 | 18.9 | 1.00 | 0.78 | Example |
| 2 | GI material | 33 | 67 | F + M | 1.7 | 112 | 595 | 804 | 0.74 | 19.3 | 0.97 | 0.74 | Example |
| 3 | GA material | 31 | 69 | F + M | 2.4 | 51 | 566 | 820 | 0.69 | 18.3 | 1.02 | 0.77 | Example |
| 4 | GA material | 35 | 65 | F + M | 5.4 | 236 | 573 | 807 | 0.71 | 18.0 | 0.95 | 0.67 | Comparative example |
| 5 | GA material | 40 | 60 | F + M | 5.3 | 175 | 572 | 794 | 0.72 | 18.9 | 0.96 | 0.69 | Comparative example |
| 6 | GA material | 36 | 64 | F + M | 5.4 | 167 | 563 | 816 | 0.69 | 17.5 | 0.99 | 0.68 | Comparative example |
| 7 | GA material | 30 | 70 | F + M | 4.9 | 253 | 596 | 816 | 0.73 | 18.7 | 1.00 | 0.68 | Comparative example |
| 8 | GA material | 37 | 63 | F + M | 1.9 | 369 | 562 | 792 | 0.71 | 18.8 | 1.01 | 0.58 | Comparative example |
| 9 | GA material | 83 | 17 | F + M | 6.3 | 89 | 712 | 879 | 0.81 | 13.9 | 0.97 | 0.62 | Comparative example |
| 10 | GA material | 39 | 61 | F + M | 6.5 | 92 | 569 | 779 | 0.73 | 18.4 | 0.86 | 0.50 | Comparative example |
| 11 | GA material | 16 | 84 | F + M | 5.9 | 59 | 385 | 601 | 0.64 | 25.3 | 0.97 | 0.63 | Comparative example |
| 12 | GA material | 19 | 81 | F + M | 4.5 | 225 | 524 | 771 | 0.68 | 18.5 | 1.02 | 0.69 | Comparative example |
| 13 | CR material | 53 | 44 | F + M + B | 2.2 | 113 | 725 | 1007 | 0.72 | 15.1 | 0.99 | 0.79 | Example |
| 14 | GI material | 52 | 48 | F + M | 2.7 | 100 | 753 | 1017 | 0.74 | 14.6 | 1.00 | 0.77 | Example |
| 15 | GA material | 55 | 45 | F + M | 2.4 | 94 | 712 | 1003 | 0.71 | 15.4 | 1.01 | 0.77 | Example |
| 16 | CR material | 69 | 29 | F + M + B | 2.0 | 85 | 870 | 1226 | 0.71 | 12.2 | 1.01 | 0.78 | Example |
| 17 | GI material | 67 | 33 | F + M | 1.3 | 104 | 895 | 1226 | 0.73 | 12.8 | 0.97 | 0.75 | Example |
| 18 | GA material | 68 | 32 | F + M | 2.2 | 106 | 894 | 1208 | 0.74 | 12.7 | 0.97 | 0.77 | Example |
| 19 | CR material | 45 | 49 | F + M + B | 1.9 | 120 | 687 | 995 | 0.69 | 14.9 | 1.00 | 0.74 | Example |
| 20 | GI material | 54 | 46 | F + M | 2.4 | 81 | 723 | 991 | 0.73 | 14.9 | 0.99 | 0.74 | Example |
| 21 | GA material | 46 | 54 | F + M | 1.5 | 56 | 745 | 1007 | 0.74 | 14.8 | 1.01 | 0.76 | Example |
| 22 | CR material | 67 | 29 | F + M + B + RA | 1.4 | 71 | 892 | 1222 | 0.73 | 13.1 | 1.02 | 0.79 | Example |
| 23 | GI material | 66 | 34 | F + M | 1.4 | 86 | 860 | 1211 | 0.71 | 12.8 | 1.02 | 0.74 | Example |
| 24 | GA material | 66 | 34 | F + M | 1.2 | 84 | 903 | 1237 | 0.73 | 12.6 | 1.01 | 0.79 | Example |
| 25 | CR material | 36 | 59 | F + M + B | 1.7 | 107 | 561 | 802 | 0.70 | 18.9 | 0.97 | 0.74 | Example |
| 26 | GI material | 35 | 65 | F + M | 2.3 | 91 | 547 | 793 | 0.69 | 19.2 | 1.02 | 0.79 | Example |
| 27 | GA material | 35 | 65 | F + M | 2.3 | 65 | 592 | 800 | 0.74 | 18.3 | 0.98 | 0.75 | Example |
| 28 | GA material | 25 | 75 | F + M | 2.5 | 58 | 496 | 729 | 0.68 | 19.9 | 1.01 | 0.79 | Comparative example |
| 29 | GA material | 65 | 35 | F + M | 2.2 | 101 | 735 | 1081 | 0.68 | 14.5 | 0.97 | 0.67 | Comparative example |
| 30 | GA material | 9 | 91 | F + M | 6.8 | 76 | 399 | 623 | 0.64 | 23.6 | 0.98 | 0.63 | Comparative example |
| 31 | GA material | 86 | 0 | M + B | — | 109 | 928 | 1079 | 0.86 | 11.0 | 0.98 | 0.60 | Comparative example |
| 32 | GA material | 40 | 60 | F + M | 6.6 | 87 | 540 | 783 | 0.69 | 19.6 | 0.99 | 0.68 | Comparative example |
| 33 | GA material | 36 | 64 | F + M | 6.8 | 75 | 531 | 781 | 0.68 | 19.2 | 0.98 | 0.67 | Comparative example |
| 34 | GA material | 31 | 69 | F + M | 4.9 | 85 | 533 | 784 | 0.68 | 19.3 | 0.99 | 0.70 | Example |
| 35 | GA material | 34 | 61 | F + M + B | 1.8 | 44 | 569 | 801 | 0.71 | 18.7 | 1.00 | 0.81 | Example |
| 36 | GA material | 35 | 65 | F + M | 2.6 | 23 | 578 | 814 | 0.71 | 18.3 | 0.99 | 0.81 | Example |
| 37 | GA material | 36 | 64 | F + M | 2.0 | 37 | 581 | 819 | 0.71 | 18.8 | 1.02 | 0.81 | Example |

*1 F: ferrite, M: martensite, B: bainite, RA: retained austenite

*2 Average grain size of ferrite grain in region extending from sheet surface to depth of 20 μm

*3 Number density of inclusions dispersed in region extending from sheet surface to depth of 20 μm

The invention claimed is:

1. A steel sheet having a chemical composition comprising, by mass %:

C: 0.04% or more and 0.18% or less;

Si: 0.6% or less;

Mn: 1.5% or more and 3.2% or less;

P: 0.05% or less;

S: 0.015% or less;

Al: 0.08% or less;

N: 0.0100% or less;

Ti: 0.010% or more and 0.035% or less;

B: 0.0002% or more and 0.0030% or less; and the balance being Fe and incidental impurities, wherein the steel sheet has (i) a steel microstructure having an area percentage of a ferrite phase in a range of 20% or more and 80% or less and an area percentage of a martensite phase in a range of 20% or more and 80% or less, the area percentage being determined by microstructure observation, and (ii) a surface layer portion having an average ferrite grain size of 5.0 μm or less and an inclusion density of 200 particles/$mm^2$ or less, the steel sheet has a surface hardness of 95% or more when the steel sheet has a hardness of 100% at a position ½t, where t represents a thickness of the steel sheet, away from a surface of the steel sheet in a thickness direction, and the steel sheet has a tensile strength of 780 MPa or more.

2. The steel sheet according to claim 1, wherein the chemical composition further comprises, by mass %, at least one Group selected from the group consisting of:

Group A: at least one selected from the group consisting of:

Cr: 0.001% or more and 0.8% or less,

Mo: 0.001% or more and 0.5% or less,

Sb: 0.001% or more and 0.2% or less, and

Nb: 0.001% or more and 0.1% or less, and

Group B: 1.0% or less in total of at least one selected from the group consisting of REM, Cu, Ni, V, Sn, Mg, Ca, and Co.

3. A coated steel sheet comprising a coated layer disposed on a surface of the steel sheet according to claim 1.

4. A coated steel sheet comprising a coated layer disposed on a surface of the steel sheet according to claim 2.

5. The coated steel sheet according to claim 3, wherein the coated layer is a hot-dip galvanized layer or a hot-dip galvannealed layer, and the coated layer comprises, by mass %:

Fe: 20.0% or less, and Al: 0.001% or more and 1.0% or less;

0% or more and 3.5% or less in total of at least one selected from the group consisting of Pb, Sb, Si, Sn, Mg, Mn, Ni, Cr, Co, Ca, Cu, Li, Ti, Be, Bi, and REM; and the balance being Zn and incidental impurities.

6. A method for producing a hot-rolled steel sheet, the method comprising heating a steel material having the chemical composition according to claim 1 to in a range of 1100° C. or higher and 1300° C. or lower and subjecting the steel material to hot rolling including rough rolling and finish rolling, cooling, and coiling, wherein a finishing entry temperature is 1050° C. or lower, a finishing delivery temperature is 820° C. or higher, a time from a completion of the finish rolling to a start of cooling is within 3 seconds, an average cooling rate until 600° C. is 30° C./s or more, and a coiling temperature is in a range of 350° C. or higher and 580° C. or lower.

7. A method for producing a full-hard cold-rolled steel sheet, the method comprising subjecting a hot-rolled steel sheet produced by the production method according to claim 6 to pickling at a thickness reduction in a range of 5 μm or more and 50 μm or less and, after the pickling, subjecting the resulting steel sheet to cold rolling to produce the full-hard cold-rolled steel sheet.

8. A method for producing a steel sheet, the method comprising heating a full-hard cold-rolled steel sheet produced by the production method according to claim 7 to an annealing temperature in a range of 780° C. or higher and 860° C. or lower and, after the heating, cooling the resulting steel sheet to a cooling stop temperature in a range of 250° C. or higher and 550° C. or lower at an average cooling rate of 20° C./s or more until 550° C., wherein in a temperature range of 600° C. or higher, a dew point is −40° C. or lower.

9. A method for producing a heat-treated sheet, the method comprising heating a full-hard cold-rolled steel sheet produced by the production method according to claim 7 to in a range of 780° C. or higher and 860° C. or lower and subjecting the resulting steel sheet to pickling at a thickness reduction in a range of 2 μm or more and 30 μm or less.

10. A method for producing a steel sheet, the method comprising heating a heat-treated sheet produced by the production method according to claim 9 to an annealing temperature in a range of 720° C. or higher and 780° C. or lower and, after the heating, cooling the resulting sheet to a cooling stop temperature in a range of 250° C. or higher and 550° C. or lower at an average cooling rate of 20° C./s or more until 550° C., wherein in a temperature range of 600° C. or higher, a dew point is −40° C. or lower.

11. A method for producing a coated steel sheet, the method comprising coating a steel sheet produced by the production method according to claim 8.

12. The coated steel sheet according to claim 4, wherein the coated layer is a hot-dip galvanized layer or a hot-dip galvannealed layer, and the coated layer comprises, by mass %:

Fe: 20.0% or less, and Al: 0.001% or more and 1.0% or less;

0% or more and 3.5% or less in total of at least one selected from the group consisting of Pb, Sb, Si, Sn, Mg, Mn, Ni, Cr, Co, Ca, Cu, Li, Ti, Be, Bi, and REM; and the balance being Zn and incidental impurities.

13. A method for producing a hot-rolled steel sheet, the method comprising heating a steel material having the chemical composition according to claim 2 to in a range of 1100° C. or higher and 1300° C. or lower and subjecting the steel material to hot rolling including rough rolling and finish rolling, cooling, and coiling, wherein a finishing entry temperature is 1050° C. or lower, a finishing delivery temperature is 820° C. or higher, a time from a completion of the finish rolling to a start of cooling is within 3 seconds, an average cooling rate until 600° C. is 30° C./s or more, and a coiling temperature is in a range of 350° C. or higher and 580° C. or lower.

14. A method for producing a full-hard cold-rolled steel sheet, the method comprising subjecting a hot-rolled steel sheet produced by the production method according to claim 13 to pickling at a thickness reduction in a range of 5 μm or more and 50 μm or less and, after the pickling, subjecting the resulting steel sheet to cold rolling.

15. A method for producing a steel sheet, the method comprising heating a full-hard cold-rolled steel sheet produced by the production method according to claim 14 to an annealing temperature in a range of 780° C. or higher and 860° C. or lower and, after the heating, cooling the resulting steel sheet to a cooling stop temperature in a range of 250° C. or higher and 550° C. or lower at an average cooling rate of 20° C./s or more until 550° C., wherein in a temperature range of 600° C. or higher, a dew point is −40° C. or lower.

16. A method for producing a heat-treated sheet, the method comprising heating a full-hard cold-rolled steel sheet produced by the production method according to claim 14 to in a range of 780° C. or higher and 860° C. or lower and subjecting the resulting steel sheet to pickling at a thickness reduction in a range of 2 μm or more and 30 μm or less.

17. A method for producing a steel sheet, the method comprising heating a heat-treated sheet produced by the production method according to claim 16 to an annealing temperature in a range of 720° C. or higher and 780° C. or lower and, after the heating, cooling the resulting sheet to a cooling stop temperature in a range of 250° C. or higher and 550° C. or lower at an average cooling rate of 20° C./s or more until 550° C., wherein in a temperature range of 600° C. or higher, a dew point is −40° C. or lower.

18. A method for producing a coated steel sheet, the method comprising coating a steel sheet produced by the production method according to claim 10.

19. A method for producing a coated steel sheet, the method comprising coating a steel sheet produced by the production method according to claim 15.

20. A method for producing a coated steel sheet, the method comprising coating a steel sheet produced by the production method according to claim 17.

* * * * *